US009962045B2

(12) United States Patent
Granger

(10) Patent No.: US 9,962,045 B2
(45) Date of Patent: May 8, 2018

(54) STRIP DISPENSING APPARATUS FOR FLEXIBLE MATERIAL PACKS IN COILS POSITIONED HORIZONTALLY OR VERTICALLY

(71) Applicant: Maurice Granger, Albufeira (PT)

(72) Inventor: Maurice Granger, Albufeira (PT)

( * ) Notice: Subject to any disclaimer, the term of this patent is extended or adjusted under 35 U.S.C. 154(b) by 0 days. days.

(21) Appl. No.: 15/547,132

(22) PCT Filed: Feb. 1, 2016

(86) PCT No.: PCT/FR2016/050209
§ 371 (c)(1),
(2) Date: Jul. 28, 2017

(87) PCT Pub. No.: WO2016/124848
PCT Pub. Date: Aug. 11, 2016

(65) Prior Publication Data

US 2018/0020885 A1 Jan. 25, 2018

(30) Foreign Application Priority Data

Feb. 6, 2015 (FR) ..... 15 50930

(51) Int. Cl.
*A47K 10/38* (2006.01)
*A47K 10/32* (2006.01)

(52) U.S. Cl.
CPC .. *A47K 10/3818* (2013.01); *A47K 2010/3206* (2013.01); *A47K 2010/3881* (2013.01)

(58) Field of Classification Search
CPC ..... A47K 10/38; A47K 10/3818; A47K 2010/3881; A47K 2010/3206
See application file for complete search history.

(56) References Cited

U.S. PATENT DOCUMENTS 1,889,024 A 11/1932 Marsh
4,244,493 A * 1/1981 Harrison ..... A47K 10/3818 206/205

(Continued)

FOREIGN PATENT DOCUMENTS

EP 1031760 A1 8/2000
JP 2011063291 A 3/2011

OTHER PUBLICATIONS

PCT Written Opinion from parent PCT application PCT/FR2016/050209, Translated, undated, 5 pages.

(Continued)

*Primary Examiner* — William A. Rivera
(74) *Attorney, Agent, or Firm* — Tech Valley Patent, LLC; John Pietrangelo

(57) ABSTRACT

A dispensing apparatus for strips of coiled flexible material having at regular intervals tear lines to form the strips. The apparatus includes a casing receiving the coil, the casing having a circular opening for the passage and distribution of a strip of coiled flexible material under a tensile stress. The casing also includes at least one washer fixed on the casing concentrically with the distribution opening, wherein the internal diameter of the at least one washer is smaller than the diameter of the opening. The one or more washers are made of an elastomeric material capable of being deformed under the effect of the material distribution through the opening for achieving, concomitantly, a strip cut along a tear line. The one or more washers cooperate with an element manually operable and arranged to reduce the internal diameter of the one or more washers.

18 Claims, 6 Drawing Sheets

(56) References Cited

U.S. PATENT DOCUMENTS

| | | | | | |
|---|---|---|---|---|---|
| 4,863,027 | A | * | 9/1989 | Yano | A47K 10/3818 206/390 |
| 5,141,171 | A | * | 8/1992 | Yang | A47K 10/3818 206/233 |
| 5,263,607 | A | * | 11/1993 | Temesvary | A47K 10/3818 221/304 |
| 5,352,992 | A | | 7/1994 | Koller et al. | |
| 6,145,782 | A | | 11/2000 | King et al. | |
| 2009/0045211 | A1 | | 2/2009 | Friesen et al. | |

OTHER PUBLICATIONS

International Search Report from parent PCT application PCT/FR2016/050209 dated Apr. 19, 2016, 5 pages.
PCT Written Opinion from parent PCT application PCT/FR2016/050209, undated, 7 pages.

* cited by examiner

Fig. 6
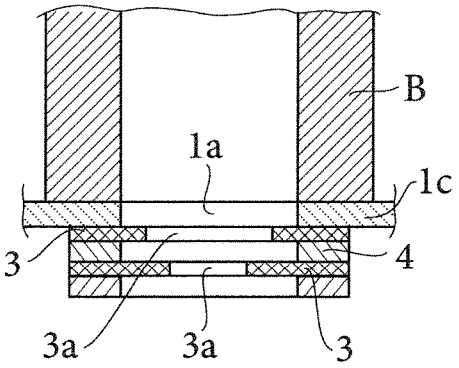
Fig. 7
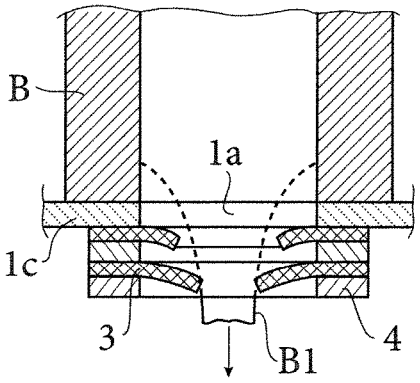
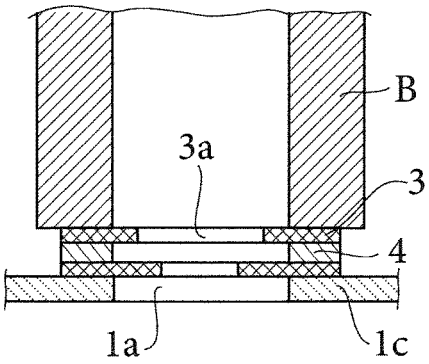
Fig. 8
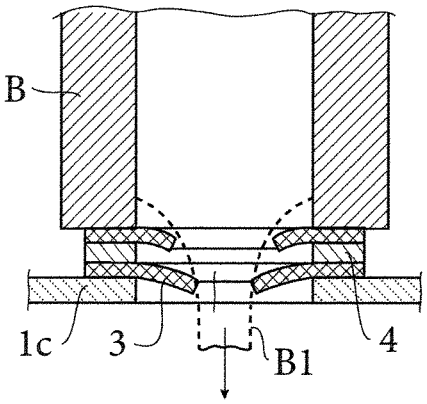
Fig. 9

STRIP DISPENSING APPARATUS FOR FLEXIBLE MATERIAL PACKS IN COILS POSITIONED HORIZONTALLY OR VERTICALLY

CROSS-REFERENCE TO RELATED APPLICATIONS

This application is a § 371 filing of PCT application PCT/FR2016/050209 filed on Feb. 1, 2016, which claims priority from French application FR 1550930 filed on Feb. 6, 2015. The disclosures of these applications are included by reference herein in their entirety.

BACKGROUND

Field of the Invention

The invention relates to the technical field of dispensing apparatus of wiping material like paper, cotton and non-woven to form, for different possible uses, strips with predetermined format as towels, paper towels, toilet paper, and generally wiping paper.

Description of Related Art

More particularly, the invention relates to dispensing apparatus of material strips with center-feed. In this type of apparatus, the coil of material is usually housed in a casing in a vertical position resting on the underside of the casing, which has a central opening to allow the passage and unwinding of the material strip pulled by the user. This unwinding occurs through the inside of the material coil, so that the outer diameter of the coil is always the same, but the material unwinding in the form of turns under the tensile stress exerted by the user progressively reduces the thickness of the coil in its useful part corresponding to the presence of material. A cover can protect the casing and the coil.

In practice, the material coil is in a pre-cut configuration, or not. Thus, the tensile strength of the user causes the strip to progress and exit from the apparatus.

This type of apparatus generates a significant waste of the material strip because the user manually cut strip lengths which do not really correspond to his needs.

Besides this waste arises a problem of control and maintenance, because the presence of such apparatus requires that they are still in charge.

To attempt to resolve these major drawbacks, the applicant has itself integrated automatic cutting devices in this type of apparatus to obtain strips formats of successive materials for the user. This has in particular been described in patent FR 2 667 854. This solution involves a certain arrangement complexity of the dispensing apparatus with respect to the conditions of use thereof.

There is known from patent US 2003/12,031 an apparatus dispensing strips of coiled precut wound material, comprising a casing receiving the coil and a hinged closure cover, the latter being provided in their front part with a central opening allowing the passage and distribution of the precut material strip.

From this state of the art of apparatus dispensing coiled material strips by means of a center guide and wound with a precut obtained during the production of the strip, one of the problems to be resolved by the invention is to design a apparatus dispensing strips of coiled precut material which is very simple, with a minimum of components and thus at a very low production cost.

To solve this problem, it has been taken into account that the distributed materials may have varying thicknesses depending on the applications and markets, and also varying hardnesses.

To solve this problem, a dispensing apparatus for strips of coiled flexible material, having at regular intervals tear lines to form the strips, has been designed and developed, the apparatus comprising in a known manner a casing receiving said coil, said casing having a circular opening for the passage and distribution of a strip under a tensile stress.

BRIEF SUMMARY OF ASPECTS OF THE INVENTION

According to the invention, the apparatus comprises at least one washer fixed on the casing concentrically with the distribution opening, the internal diameter of at least one washer being smaller than the diameter of the opening, said one or more washers being made of an elastomeric material capable of being deformed under the effect of the material distribution through said opening to achieving concomitantly a strip cut according to a tear line, said one or more washers cooperating with a manually operable element and arranged to reduce the internal diameter of the one or more washers at will.

It follows from these characteristics that the apparatus according to the invention is very simple, and therefore with a reduced production cost, considering the very small number of parts used, commercially available and sufficient to ensure a perfect cutting of the strips at the tear lines, and this on the one hand regardless of the material thickness and conformation of said tears, and regardless the way of drawing the material strip for cutting it, in combination with the washer(s) of elastomeric material.

To solve the problem consisting of reducing at will the internal diameter of said one or more washers, the manually operable element is a hollowed disk bounding a circular opening whose diameter is greater than the internal diameter of the one or more washers, the disk being fixed at the washers with a capacity for angular displacement and set eccentrically with respect to said washers for positioning the opening of the disc at different positions relative to the internal diameter of the one washers.

Advantageously, the disk is connected to a return spring in the inside diameter reduction position of the one or more washers.

From this basic design, various embodiments of the apparatus can be envisaged, particularly regarding the arrangement and number of washers in rubber-type elastomeric material.

In one embodiment, the dispensing apparatus comprises a plurality of superposed elastomeric washers having the same inside diameter.

In another embodiment, the dispensing apparatus comprises a plurality of superimposed elastomeric washers with a internal diameter decreasing towards the strip dispensing, to create a cone effect.

In another embodiment, a washer of rigid material is interposed between the elastomeric washers, whose internal diameter is at least equal to the diameter of the dispensing opening.

Whatever the embodiments, the one or more elastomeric washers are secured inside the casing, or the one or more elastomeric washers are secured outside the casing.

To solve the problem of positioning and fixing the elastomeric washers relative to the dispensing opening, the one or more elastomeric washers are mounted in combination with a support ring having fastening arrangements relative to the dispensing opening.

In one embodiment, the one or more elastomeric washers are positioned in a undercut formed in the thickness of the ring, which may have a dome shape, and is fixed by clipping onto the outer face of the casing. The manually operable member to reduce the diameter of the washers is mounted in the undercut of the ring, which has a notch for the movement of an operating member connected to said element.

According to another characteristic, the one or more elastomeric washers comprise a indexing means relative to the dispensing opening. The faces of elastomeric washers are smooth or rough.

Note that the apparatus may be designed to allow a single distribution of the material coil in different positions, vertically in the case of a center-feed, or horizontally. In other words, the user can make a possible choice for the positioning of the material coil, while maintaining the structural characteristics of the apparatus concerning the specific arrangements for cutting precut strips in a regular and constant manner.

Thus, in one embodiment, the coil of material is disposed on a vertical plane inside the casing, its central opening being opposite to the opening formed on the horizontal lower part of the casing, the coil resting on said lower portion, said apparatus being used with the center-feed of the material coil.

In another embodiment, the casing has on its side faces articulated arms whose ends are provided with tips receiving the material coil, said arms being hinged from a vertical position to a horizontal position to correspond to the positioning mode of the material coil, said arms being locked by means arranged on the casing in a vertically raised position or horizontally lowered by means arranged on the casing, said apparatus being used with the horizontal position of the material coil.

The means are, for example, constituted by providing the side faces of the casing with a recess for receiving a bossing formed on the outside part of the hinged arms, the side faces of the casing having stops limiting the tilting of the arms up to the horizontal.

BRIEF DESCRIPTION OF THE DRAWINGS

The invention is described hereinafter more in detail with the figures appended hereto in which:

FIGS. 6 to 12 show various forms for implementing and positioning the elastomeric washers for cutting a tape.

More particularly, FIGS. 6, 8 and 10 are partial, schematic and longitudinal sectional views, at the level of the washers when no tensile stress is applied on the strip, while FIGS. 7 and 9 correspond respectively to FIGS. 6 and 8, and show the action of the washers when a tensile stress is exerted on the band, for its cut.

FIG. 11 is a bottom view corresponding to FIG. 10.

DETAILED DESCRIPTION OF ASPECTS OF THE INVENTION

The dispensing apparatus for strip of flexible material is defined as a whole by (A). The coiled flexible material is designated as a whole by (B) and comprises, in known manner, at regular intervals, weakness or tear lines, or others, to form strips with predetermined lengths. Remember that the flexible material, which can be a wiping material of any known and appropriate type, paper, cotton, non-woven, being able to form towels, paper towels, toilet paper, . . . , can be realized in various thicknesses.

The apparatus comprises a casing (1) receiving the coil (B), said casing (1) having a circular opening (1*a*) for the passage and distribution of a strip (B1) under the effect of a tensile stress exerted by the user. In a non-limiting embodiment illustrated in the figures of the drawings, the receiving casing (1) has a rear face (1*b*), a horizontal bottom part (1*c*) in which is formed the dispensing opening (1*a*), and side faces (1*d*). The casing (1) receives a freely hinged cover (2). The cover and said casing have complementary locking means of any known and appropriate type. Obviously, the casing and the cover can be made in different materials and have different profiles.

According to a basic characteristic of the invention, the cutting of the material strips, at the pre-cut lines, is effected by at least one washer (3) fixed to the casing (1), particularly on the part (1*c*), concentrically to the dispensing opening (1*a*). The internal diameter (3*a*) of the washer (3) or washers (3) is smaller than the diameter of the dispensing opening (1*a*). Importantly, the washer(s) (3) is/are implemented in an elastomeric material capable of being deformed under the effect of a distribution of the material through said opening (1*a*), to cause concomitantly a cutting of a strip according to a considered tear line.

For example, the washer(s) (3) of elastomeric material can be implemented in all types of rubbery material, whose hardness is variable and may depend on the nature of the material.

Similarly, the washers (3) may be smooth or have a certain roughness. The one or more elastomeric washers (3) may also be formed by an O-ring.

Figure 12:
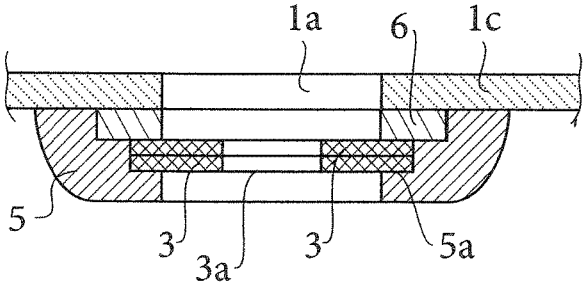

In FIG. 12, the elastomeric washer(s) (3) is/are mounted in combination with a support ring (5) having fastening arrangements, with respect to the dispensing opening (1*a*). For example, the washer(s) (3) is/are positioned in an undercut (5*a*) formed in the thickness of the ring (5) by being maintained therein by a rigid washer (6). The ring (5) may have a dome shape and can be fixed by clipping, for example, at the external face of the casing (1) on the bottom part (1*c*) and co-axially to the dispensing opening (1*a*).

Advantageously, the washer(s) (3) cooperate(s) with a element (7) manually operable and arranged to reduce at will the internal diameter of the washer(s) (3). This element (7) consists for example of a hollowed disc bounding a circular opening (7*a*) whose diameter is greater than the internal diameter of the elastomeric washer(s) (3). The disc (7) is positioned co-axially at the elastomeric washer(s) (3), with capacity of eccentric angular displacement with respect to said washers. For example, the disk (7) is fixed to a rigid washer (4) by means of a pivot axis (18). The rigid washer (4) is for example fastened to the outside of the casing (1), concentrically to the opening (1*a*) of said casing. This offset hinge (18) results in that when someone acts on the disc (7) for example by means of an operating member in the form of a finger (7*b*), the opening (7*a*) of the disc is set in various orientations relative to the internal diameter of the washer(s) (3), thus changing its diameter (dashed lines, FIG. 11).

Note that the top face of the disc (7) in contact with the washer (4) may be covered with a rubbery material (12). Advantageously, the disc (7) is connected to a return spring (13) in a reduction position of the internal diameter of the washer(s) (3). Similarly, the disc is preferably mounted in the undercut (5*a*) of the ring (5), which has a notch for the deployment of the finger (7*b*).

It follows from these characteristics that in one position of the disc (7), the opening (7*a*) of the latter is arranged concentrically with the dispensing opening (1*a*) of the apparatus, to permit the engagement of the paper after loading the coil for a first use.

Figure 1:
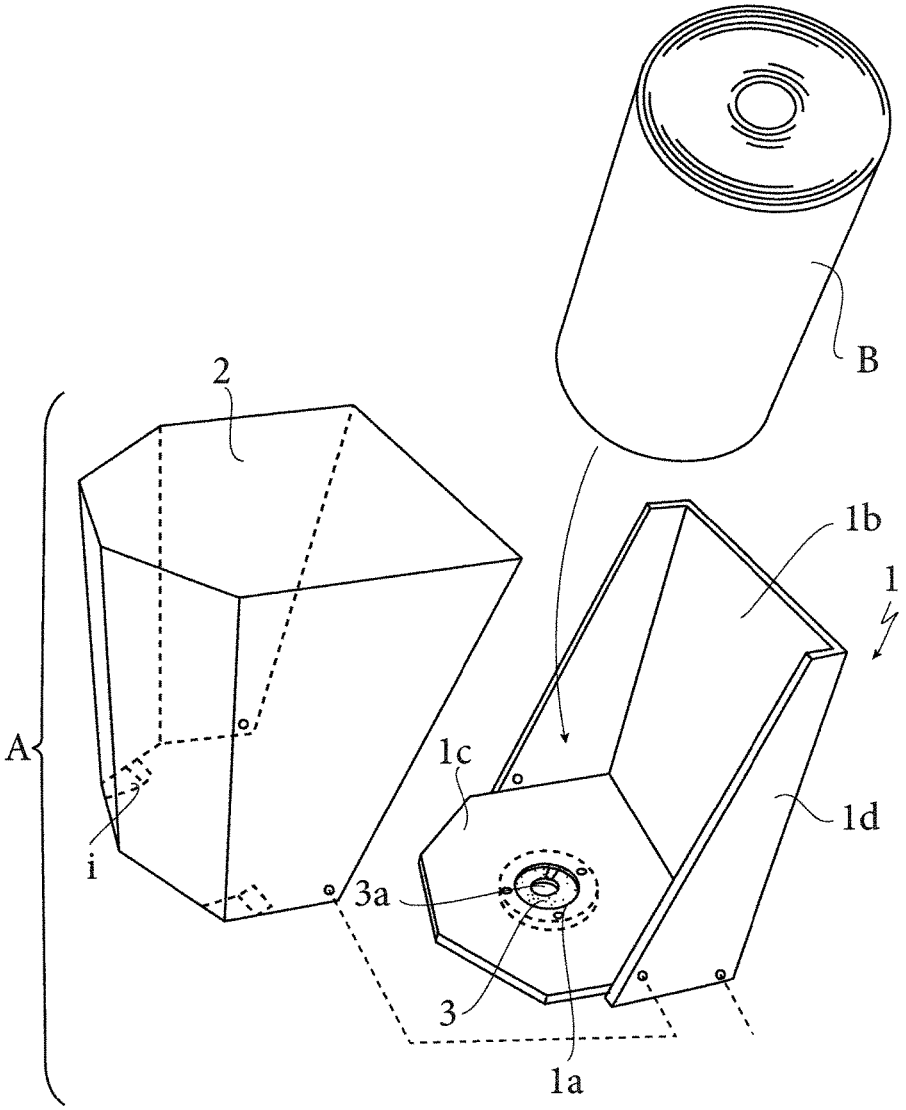
FIG. 1 is a perspective view before assembly of the main components of the apparatus according to the invention.
Figure 2:
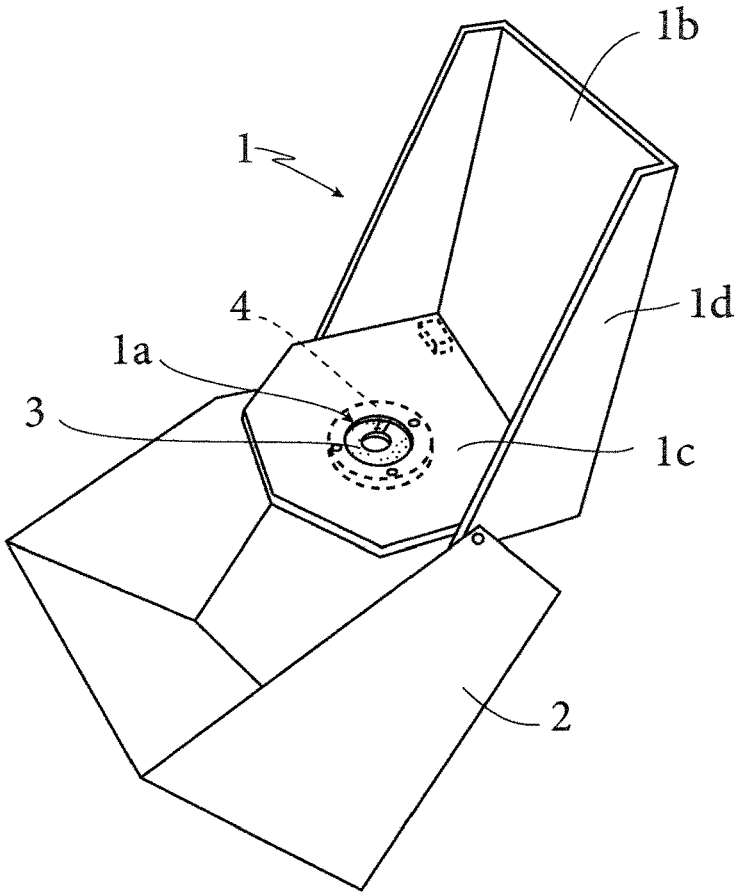
FIG. 2 is a perspective view of the apparatus in the open position prior to placement of a coil.
Figure 3:
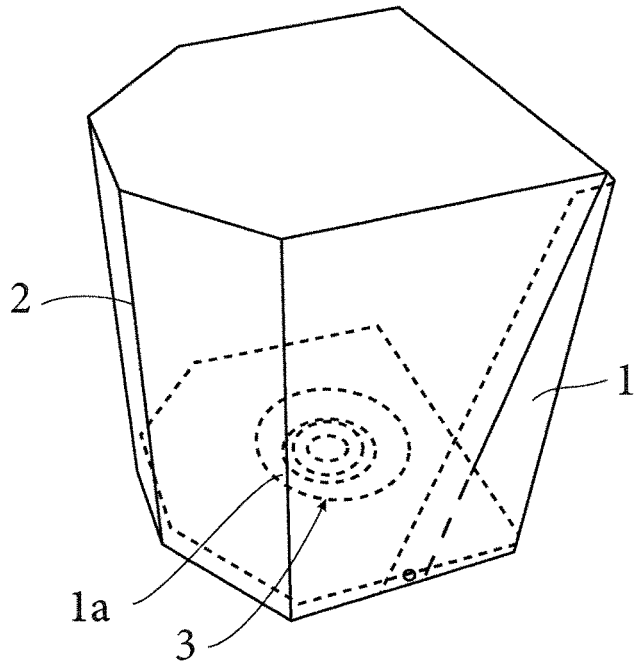
FIG. 3 is a perspective view of the apparatus in closed position.
Figure 4:
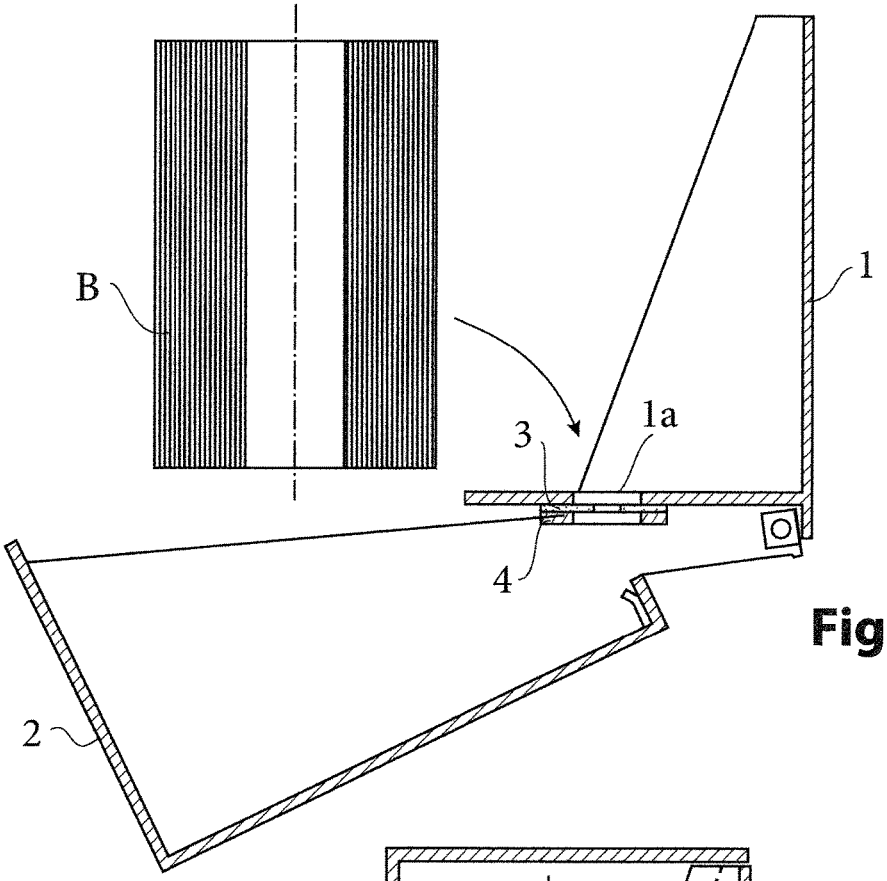
FIG. 4 is a longitudinal sectional view of the apparatus in the open position, and prior to placement of the coil.
Figure 5:
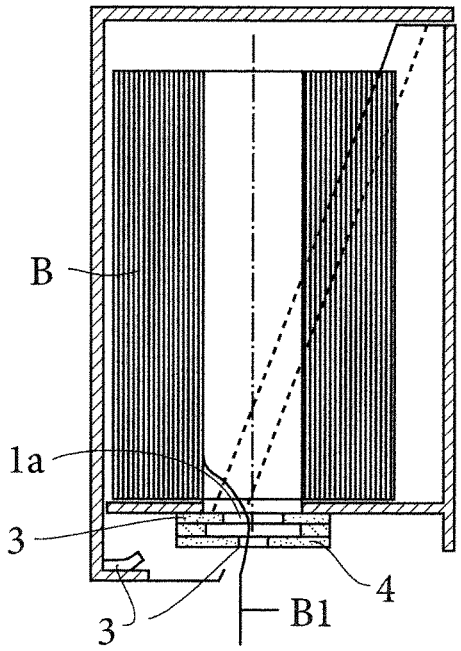
FIG. 5 is a view corresponding to FIG. 4, after placement of the coil and closing of the apparatus.
Figure 10:
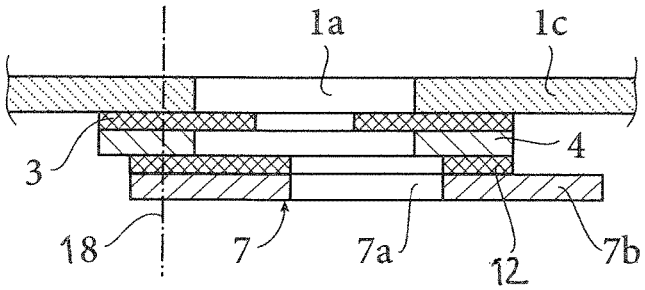
Figure 11:
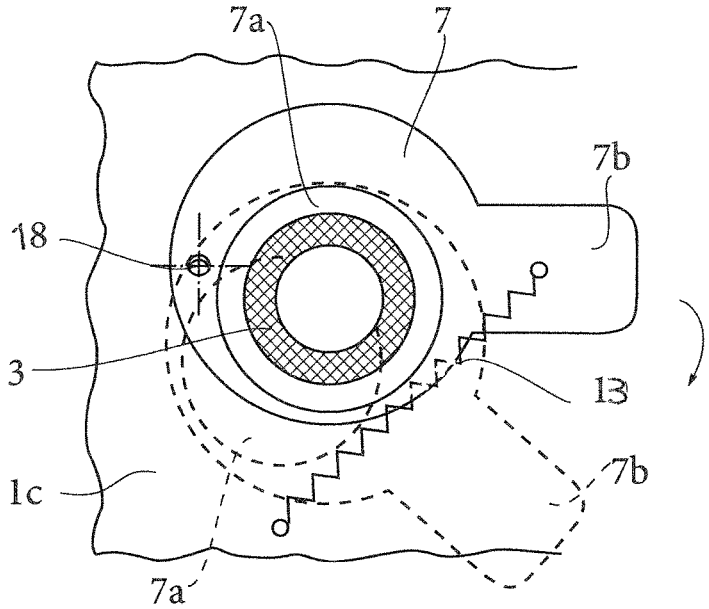

In another position of the disk, the opening (7*a*) is eccentric relative to the opening (1*a*), corresponding to a decrease of the diameter of the washers (3) for dispensing and cutting a strip under a small tensile stress exerted on the paper projecting from the opening (1*a*) (dashed lines, FIG. 11).

From this basic concept, various embodiments can be envisaged, as shown in particular in FIGS. 6 to 12 of the drawings.

For example, the opening (1*a*) may be in communication with several washers (3) superimposed and having the same internal diameter (FIG. 12), or the opening (1*a*) may be in communication with several washers (3) superimposed and with an internal diameter decreasing toward the strip dispensing to create a cone effect (FIGS. 6, 7, 8, 9).

In a preferred embodiment which can however not be considered as limiting, and in the case of several elastomeric washers (3), a washer (4) made of rigid material is interposed between said washers (3), whose internal diameter (4*a*) is at least equal to the diameter of the dispensing opening (1*a*).

Whatever the embodiments, that is to say the arrangements of the washers, the latter can be fixed outside the casing (6, 7, and 10, 11) or inside the casing (8, 9). The different elastomeric washers (3) and the rigid washers (4) comprise all types of angular indexing means and all types of fastening means, relative to the dispensing opening (1*a*).

Whatever the embodiments and the arrangements of the elastomeric washers (3), after having engaged the material through the dispensing opening (1*a*), and therefore through the internal diameter (3*a*) of the elastomeric washer(s) (3), this or these latter deforms(s) resiliently under the effect of the tensile stress exerted on the material. This results in a pinching action at said material, causing concomitantly a cutting of a strip at the considered precut or weakness line, and this whatever the intensity and orientation of the tensile force exerted by the user on the material. It refers more particularly to FIGS. 7 and 9 of the drawings.

In the embodiments illustrated in particular in FIGS. 1 to 12), the material is disposed in a vertical plane, the central opening of the coil being arranged opposite to the dispensing opening (1*a*) formed in the thickness of the lower part (1*c*) of the casing (1). The coil (B) rests on this lower part, and the washer(s) (3) and/or (4), when this or these latter is/are fastened inside the casing (1). In this embodiment, the apparatus is used with the unwinding by the center of the material coil.

Figure 13:
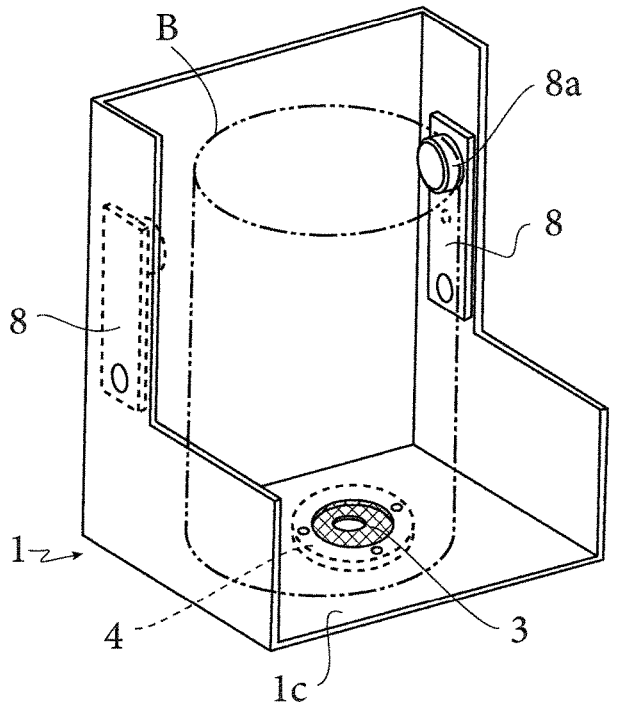
FIGS. 13 and 14 show, by way of example, an embodiment in a vertical using position of the coil (FIG. 13), and in a horizontal operating using of the coil (FIG. 14).
Figure 14:
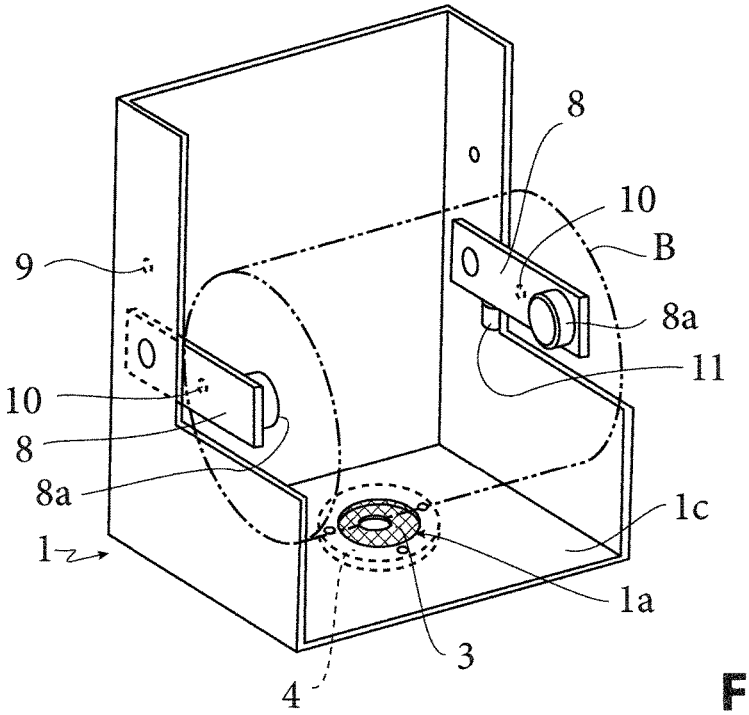

FIGS. 13 and 14 show, by way of indicative but not limitative example, an embodiment of the apparatus, in particular with respect to the casing, for the dispensing of coil material in a vertical position (FIG. 13), or in a horizontal position (FIG. 14). The casing (1) comprises hinged arms (8) on its side faces, whose ends are provided with tips (8*a*) receiving the material coil (B). The arms (8) are hinged from a vertical position to a horizontal position to correspond to the positioning mode of the material coil. The arm (8) can be locked in a vertically raised position for a vertical use of the coil (FIG. 13), or a horizontally lowered position for a horizontal use of the coil (FIG. 14) by means (9) (10) and (11) arranged on the casing (1). For example, these means are made by providing the side faces of the casing with a recess (9) on reception of a bossing (10) formed on the outside part of the hinged arm (8). The side faces of the casing comprise stops (11) limiting the tilting of the arm to the horizontal or substantially horizontal position.

The advantages are well apparent from the description. It emphasized and recalled the apparatus design simplicity for the cutting of pre-cut strips and materials by the use of simple elastomeric washers, of the type of those commonly used in trade.

The invention claimed is:

1. A dispensing apparatus for coiled flexible material having tear lines to form strips, the apparatus comprising:

a casing receiving the coiled flexible material, the casing having an opening for passage of the coiled flexible material;

at least one washer mounted to the casing about the opening in the casing, an internal diameter of the at least one washer being smaller than the opening in the casing, the at least one washer made of an elastomeric material deformable under an effect of passage of the coiled flexible material through the opening in the casing; and a pivotally-mounted element having an opening, wherein when the pivotally-mounted element is pivoted, misalignment between the opening of the pivotally-mounted element and the internal diameter of the least one washer restricts passage of the coiled flexible material through the internal diameter of the at least one washer and the opening of the pivotally-mounted element to enhance tearing along the tear lines of the coiled flexible material.

2. The dispensing apparatus according to claim 1, wherein the opening of the pivotally-mounted element comprises a diameter greater than the internal diameter of the at least one elastomeric washer.

3. The dispensing apparatus according to claim 2, wherein the pivotally-mounted element is connected to a return spring.

4. The dispensing apparatus according to claim 2, wherein the pivotally-mounted element comprises a hollowed disk having the opening, wherein the hollowed disk is angularly displaceable with respect to the at least one elastomeric washer for positioning the hollowed disc opening at different positions relative to the internal diameter of the at least one elastomeric washer.

5. The dispensing apparatus according to claim 1, wherein the at least one washer comprises a plurality of washers, and wherein each of the internal diameters of the plurality of washers have a same internal diameter.

6. The dispensing apparatus according to claim 1, wherein the at least one washer comprises a plurality of washers, and wherein each of the internal diameters of the plurality of washers varies in size.

7. The dispensing apparatus according to claim 6, wherein each of the internal diameters of the plurality of elastomeric washers which vary in size comprises an internal diameter of one of the plurality of elastomeric washers is less than an internal diameter of another of the plurality of elastomeric washers.

8. The dispensing apparatus according to claim 1, wherein the apparatus further comprises a washer of rigid material interposed between the at least one elastomeric washer, wherein an internal diameter of the washer of rigid material is at least equal in size to the opening of the casing.

9. The dispensing apparatus according to claim 8, wherein a mounting of the washer of rigid material and the at least one elastomeric washer comprises an indexing means relative to the opening of the casing.

10. The dispensing apparatus according to claim 1, wherein the at least one elastomeric washer is fastened inside the casing.

11. The dispensing apparatus according to claim 1, wherein the at least one elastomeric washer is fastened outside the casing.

12. The dispensing apparatus according to claim 1, wherein the at least one elastomeric washer is mounted in combination with a support ring fastened about the opening of the casing.

13. The dispensing apparatus according to claim 12, wherein the at least one elastomeric washer mounted in combination with the support ring comprises the at least one elastomeric washer positioned in an undercut formed in the support ring.

14. The dispensing apparatus according to claim 12, wherein the support ring has a dome shape, and wherein the support ring fastened about the opening of the casing comprises the support ring mounted by clipping onto an outer face of the casing.

15. The dispensing apparatus according to claim 1, wherein faces of the at least one elastomeric washer are one of smooth and rough.

16. The dispensing apparatus according to claim 1, wherein the casing receiving the coiled flexible material comprises the coiled flexible material disposed on a vertical plane in the casing, wherein a central opening of the coiled flexible material is positioned opposite the opening of the casing, wherein the opening of the casing is positioned on a horizontal lower part of the casing, and wherein the coiled flexible material is supported on the horizontal lower part.

17. The dispensing apparatus according to claim 1, wherein the casing further comprises hinged arms, the hinged arms having ends provided with tips receiving the coiled flexible material, the hinged arms being hinged from a vertical position to a horizontal position, the horizontal position corresponding to a positioning mode of the coiled flexible material, the hinged arms being locked by locking means arranged on the casing in a vertically raised position or being locked by locking means for use in a vertical position of the horizontally lowered coiled flexible material.

18. The dispensing apparatus according to claim 17, wherein the locking means comprises recesses in sides of the casing adapted for receiving a bossing formed on an outside part of each of the hinged arms, each of the sides of the casing having a stop limiting tilting of the hinged arms.

* * * * *